US007779773B2

(12) United States Patent
Little et al.

(10) Patent No.: US 7,779,773 B2
(45) Date of Patent: Aug. 24, 2010

(54) DEVICE FOR HOLDING WATER BOTTLE OR OTHER OBJECT IN WATERCRAFT OR OTHER MOBILE CONVEYANCE

(76) Inventors: Gregory R. Little, 1811 S. Hobart Blvd., Los Angeles, CA (US) 90006; Michael J. Strasser, 548-B Presidlo Blvd., San Francisco, CA (US) 94129; William G. Tammen, 1211 Waller St., San Francisco, CA (US) 94117

( * ) Notice: Subject to any disclaimer, the term of this patent is extended or adjusted under 35 U.S.C. 154(b) by 0 days.

(21) Appl. No.: 12/151,322

(22) Filed: May 5, 2008

(65) Prior Publication Data

US 2008/0314310 A1 Dec. 25, 2008

Related U.S. Application Data

(60) Provisional application No. 60/927,537, filed on May 3, 2007.

(51) Int. Cl.
*B63B 17/00* (2006.01)

(52) U.S. Cl. ..... 114/364; 114/174

(58) Field of Classification Search ..... 114/174, 114/343, 364
See application file for complete search history.

(56) References Cited

U.S. PATENT DOCUMENTS

| | | | | |
|---|---|---|---|---|
| 4,280,434 | A * | 7/1981 | Beckerer, Jr. | 114/174 |
| 4,757,803 | A * | 7/1988 | Dixon | 114/364 |
| 4,823,724 | A * | 4/1989 | Lumpkin | 114/343 |
| 4,955,835 | A * | 9/1990 | Hollingsworth | 114/174 |
| 6,112,694 | A * | 9/2000 | Burgos | 114/364 |

* cited by examiner

*Primary Examiner*—Lars A Olson
(74) *Attorney, Agent, or Firm*—William A. Loginov; Loginov & Associates, PLLC

(57) ABSTRACT

A stowage device for a mobile conveyance such as a watercraft. In the case of a watercraft, the stowage device replaces an inspection port cover. The stowage device is adapted to screw into the existing inspection port with no modification. The stowage device incorporates a stowage cavity to securely hold a drink bottle or other liquid refreshment container or object easily accessible within an arm's length of an operator.

52 Claims, 5 Drawing Sheets

DEVICE FOR HOLDING WATER BOTTLE OR OTHER OBJECT IN WATERCRAFT OR OTHER MOBILE CONVEYANCE

CROSS-REFERENCE TO RELATED PATENT APPLICATION

This application relates to U.S. Provisional Patent Application No. 60/927,537 filed on May 3, 2007, entitled DEVICE FOR HOLDING WATER BOTTLE IN WATERCRAFT, which is hereby incorporated herein in its entirety by this reference.

BACKGROUND OF THE INVENTION

1. Field of the Invention

The present invention relates to equipment for watercraft or other mobile conveyances and, more particularly, to stowage equipment for liquid refreshments or other objects on mobile conveyances such as watercraft. Specifically, one preferred embodiment of the present invention provides a readily accessible and secure stowage device for a liquid refreshment container or other object incorporated into a mobile conveyance such as a hull inspection port commonly found on a watercraft.

2. Description of the Prior Art

Among numerous mobile conveyances, there are hundreds of thousands of small watercraft in regular use, including small sailboats, kayaks, motorboats, and the like. Generally, the size and design of these watercraft are oriented toward speed, agility, and performance, often in racing situations, at the expense of stability on the water. They frequently lack even the most basic amenities found on larger boats, and have little or no storage space, particularly of the kind that the operator can access quickly and easily without compromising stability and control of the boat. These boats require a great deal of physical exertion to sail or row and often operate in a windy, sunny, and frequently saltwater environment, making hydration a real concern for racers and recreational boaters alike.

One of the constant challenges for boaters is how to keep a drink bottle or other object secured, yet accessible, in a dynamic environment on boats that require having at least one hand engaged at all times. A popular online forum for Laser sailboats (one of the most popular boats of the type described above, with over 200,000 sold in 28 years of continuous production) shows how sailors struggle for a solution to the problem of accessibility to liquid replenishment: http://www.laserforum.org/showthread.php?t=4607.

The problem of stowing a drink bottle or other liquid refreshment container or object on a watercraft for ready accessibility during operation continues to exist. It is an object of the present invention to provide a readily accessible liquid refreshment container or object stowage device for watercraft or other mobile conveyance such as an all terrain vehicle or other land-based vehicle or aircraft such as a glider or airplane. It is also an objective of the present invention to provide such a device which is effective and which does not interfere with the operation of the watercraft or other mobile conveyance. It is a further objective of the present invention to provide such a device for a watercraft which retains the container or object in a capsize situation and also holds an empty container in place if the device fills with water. Various embodiments of the present invention provide a solution to the liquid refreshment container or object stowage problem in a watercraft or other mobile conveyance.

SUMMARY OF THE INVENTION

In accordance with one aspect of the present invention, it is recognized that many boats of the aforementioned type have inspection ports that allow access to the inside of the hull for maintenance purposes. These are installed either by the manufacturer or are easily added by the owners as aftermarket items. For example, the five- and six-inch Viking Marine inspection ports are by far the most popular. For a variety of reasons, these inspection ports are typically located within an arm's length of the cockpit or seating area.

In accordance with one aspect of the present invention, the hydration problem is solved by supplying watercraft with a replacement inspection port lid easily accessible within an arm's length of the operator, that incorporates a stowage cavity to hold a drink bottle or other liquid refreshment container or object securely. In accordance with one preferred embodiment of the present invention, the lid is adapted to screw into an existing inspection port with no modification.

The foregoing and other objects, features, and advantages of the present invention will become more readily apparent from the following detailed description of various embodiments of the present invention, which proceeds with reference to the accompanying drawing.

BRIEF DESCRIPTION OF THE DRAWING

The various embodiments of the present invention will be described in conjunction with the accompanying figures of the drawing to facilitate an understanding of the present invention. In the figures, like reference numerals refer to like elements. In the drawing.

DETAILED DESCRIPTION OF THE PREFERRED EMBODIMENTS

Figure 1:
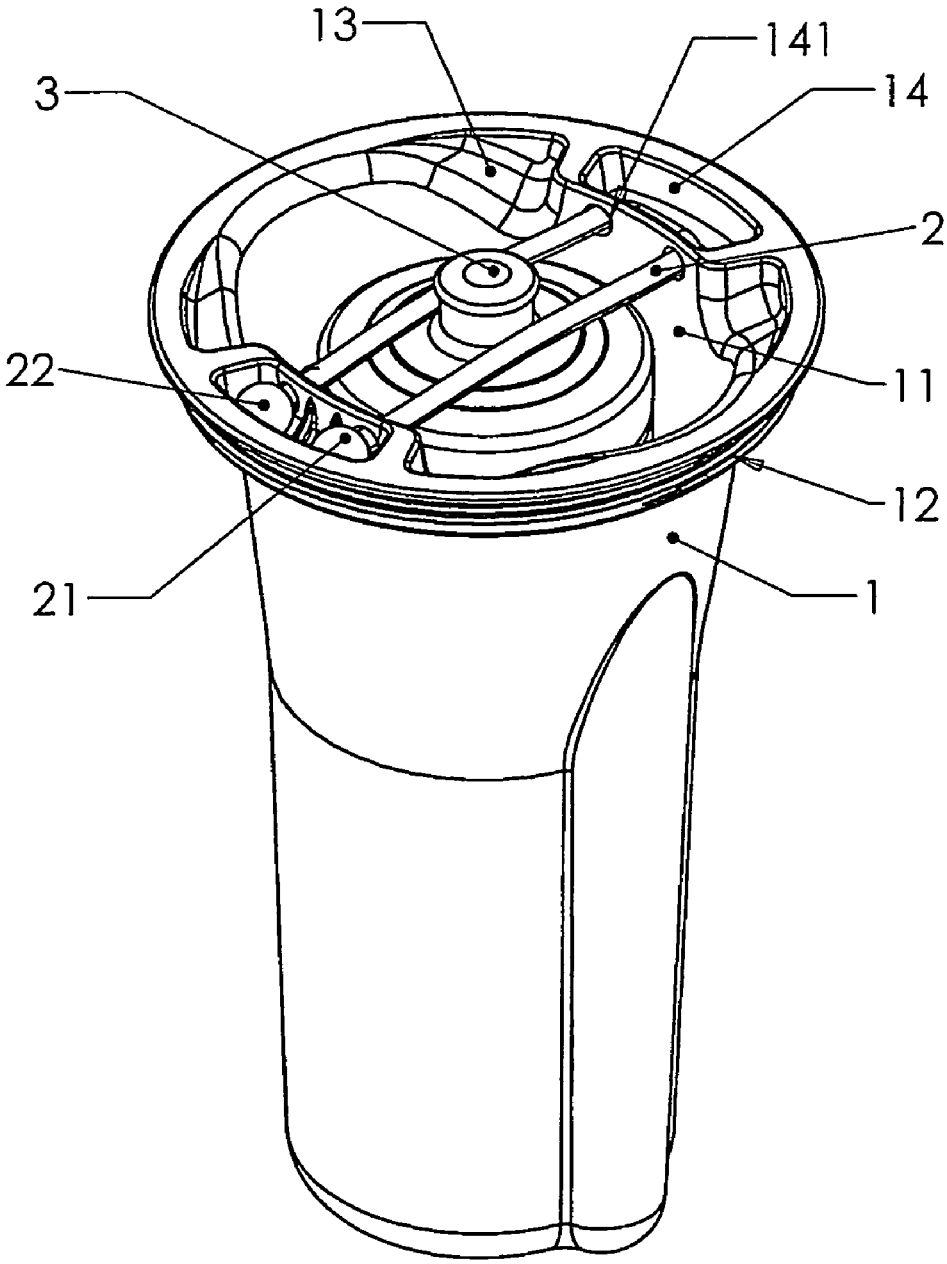
FIG. 1 is an isometric view of one embodiment of the stowage device in accordance with the present invention holding a water bottle.
Figure 3:
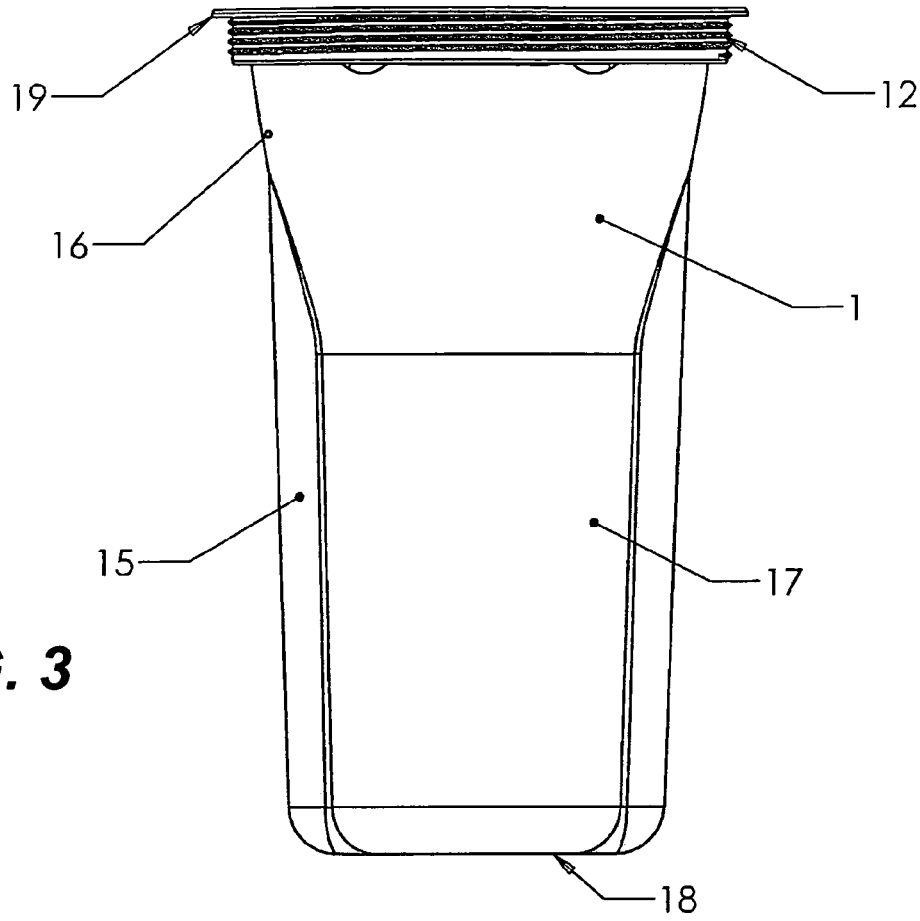
FIG. 3 is a side view of the stowage device shown in FIG. 1.

FIG. 1 shows one embodiment of the stowage device in accordance with the present invention. A water bottle or other liquid refreshment container or other object 3 is disposed in a stowage cavity 11 in a main body 1. As shown in FIG. 3, the main body 1 comprises threads 12 positioned proximate a sealing lip 19 of the main body exterior to the stowage cavity 11. Referring again to FIG. 1, the bottle or container or object 3 is secured by securing means, for example, resilient elastic material such as a shock cord 2 which is tied at one end 21, threaded through holes 141 in a first shock cord cavity 14 at one side of the main body 1 to form a U shape, and is terminated at the other end by a knot 22, with the knots 21, 22 disposed in a second shock cord cavity 14 at the opposite side of the main body. For example, the shock cord 2 may be a commercially available one-eight-inch diameter shock cord commonly available for sale at outdoor equipment or hardware stores. Preferably, the depth of the shock cord cavities 14 is such that the knots 21, 22 are substantially flush with the top of the main body 1. The shock cord cavities 14 on each side of the top of the main body 1 also preferably serve as finger stops to facilitate screwing and unscrewing of the stowage device.

The shock cord 2 may flex outwardly so that the bottle or container or object 3 can be manually pushed in and pulled out of the stowage cavity 11 in the main body 1. When the user forces the bottle or container or object 3 in or out of the stowage cavity 11, the force causes the shock cord 2 to stretch apart and expand laterally. However, if the boat were to capsize or otherwise encounter forces that would tend to eject the bottle or container or object 3 were it not secured, the movement of the bottle or container or object is constrained, and cannot produce enough force or momentum to push the shock cord 2 apart so as to release the bottle or container or object. Additionally, the shock cord 2 retains an empty or partially empty bottle or container from floating out of the stowage cavity 11 in the event that water enters the cavity to a sufficient extent that the resulting buoyancy exceeds the weight of the bottle or container.

If any size bicycle water bottle style container is used, the shock cord 2 holds the container in a "ready position" partially protruding from the stowage cavity 11 for convenient access. This feature is made possible by the indentation present in typical water bottles intended to sit in a bottle cage on a bicycle. The shock cord 2 retains the water bottle by tightening on this indention instead of stretching over the top of the bottle.

Figure 2:
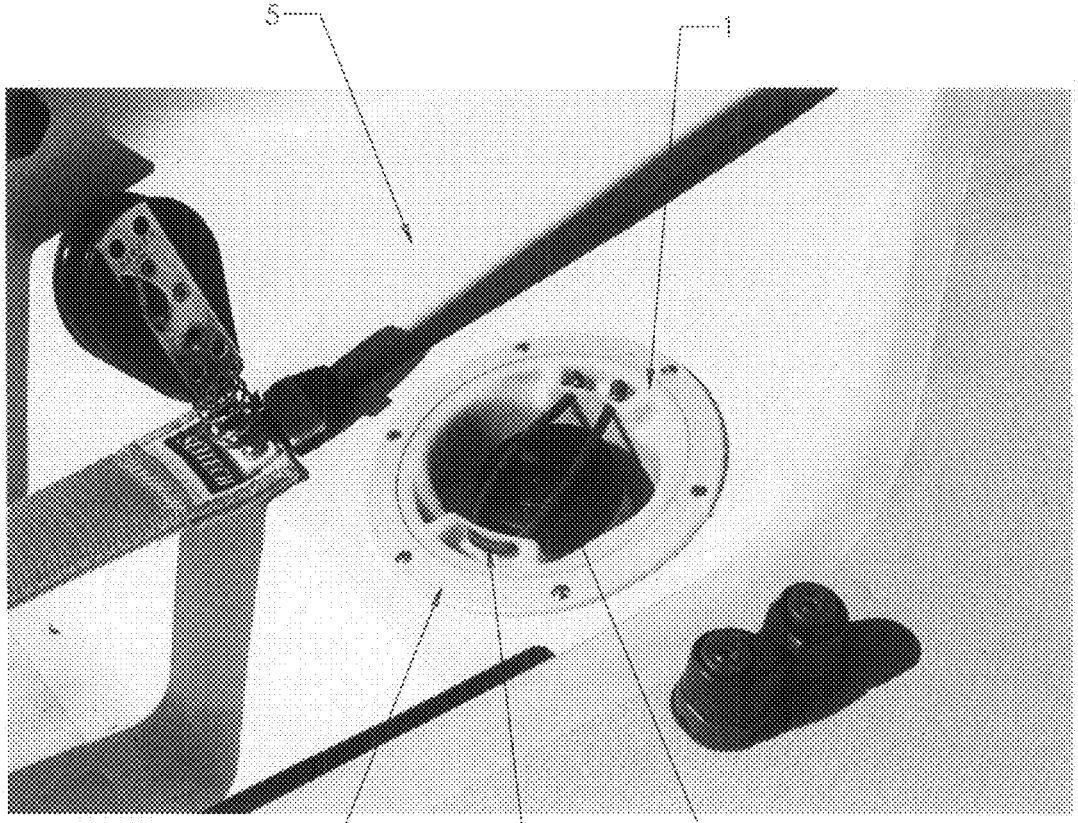
FIG. 2 is a view of the stowage device shown in FIG. 1 installed on a boat.
Figure 4:
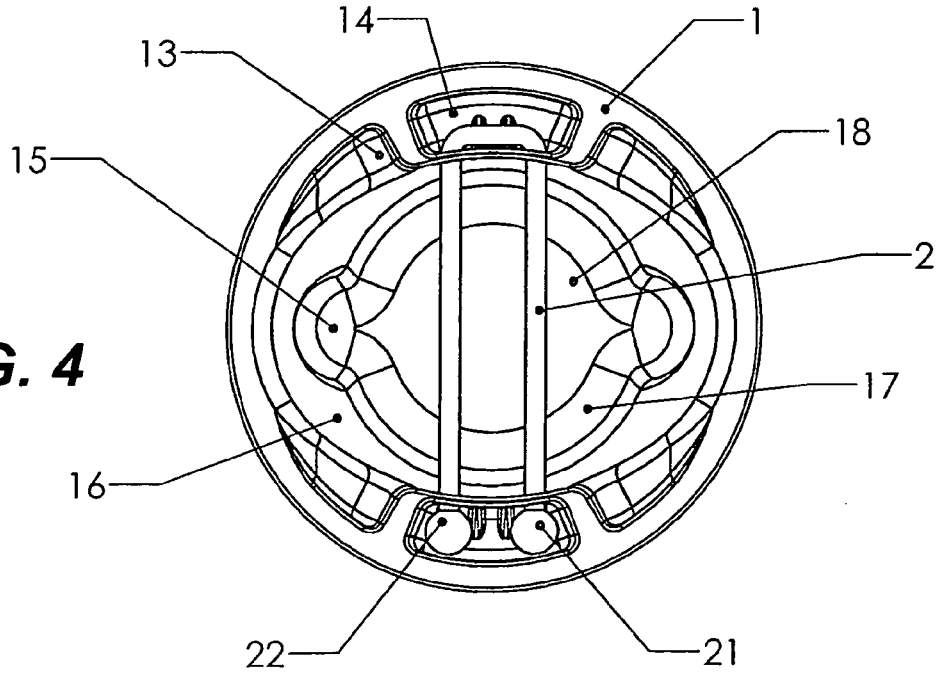
FIG. 4 is a top view of the stowage device shown in FIG. 1.

FIG. 2 illustrates the stowage device shown in FIG. 1 installed in the hull inspection port 4 on a boat 5. The threads 12 shown in FIG. 1 are configured to match those of a cover for the inspection port 4, for example, the threads of a five- or six-inch Viking Marine inspection port cover, which is already installed on many watercraft. To install the stowage device on a boat 5, the user simply removes the existing cover for the inspection port 4 and threads the main body 1 into the inspection port. Referring to FIGS. 1 and 4, indentations 13 are preferably provided at the top of the main body 1 to facilitate threading the main body on and off to install or remove the stowage device, respectively.

FIG. 3 illustrates a side view of the stowage device shown in FIG. 1. FIG. 3 more clearly illustrates the threads 12 than the isometric view of FIG. 1. FIG. 3 also shows the sealing lip 19 of the main body 1, which acts as a sealing surface when the main body is tightened down on the inspection port 4. The sealing lip 19 extending outwardly above the threads 12 seals with the existing O-ring of the inspection port 4 to provide the same secure, watertight seal as the original inspection port cover. Finally, FIG. 3 illustrates that a portion of the stowage cavity 11 preferably flares out between the bottom and top of the stowage cavity, and preferably at the top of the main body 1, creating a larger elliptical opening 16 as shown in FIG. 1. The opening 16 allows the user more space to fit his or her hand in order to retrieve a shorter bottle or container or object 3, while still tightly constraining the bottom of the bottle or container or object. Preferably, the top of the flared portion of the main body 1 is sufficiently inward of the threads 12 so that the stowage device is also fully compatible with the additional installation of a conventional inspection port bag, although the stowage device will occupy much of the volume in the bag. The base 18 of the main body 1 has a depth relative to the top of the main body of preferably approximately nine inches to ensure that the top of the vast majority of commonly used bottles or containers or objects 3 will be approximately flush with the top surface. This ensures that the top of the bottle or container or object 3 will not catch on any stray ropes, etc., sweeping across the deck of the boat 5.

FIG. 4 illustrates a top view of the stowage device shown in FIG. 1. FIG. 4 more clearly illustrates the U-shape of the shock cord 2. FIG. 4 also shows a top view of the elliptical opening 16, illustrating how the aperture at the top of the main body 1 changes from a circular shape 17 to an elliptical shape. Finally, FIG. 4 shows two drain port channels 15 preferably incorporated on opposite sides of the stowage cavity 11. When a bottle or container or object 3 is pressed down into the stowage cavity 11, any water at the base 18 of the main body 1 will be forced out through the drain port channels 15, so that the bottle or container or object will be inserted all the way to the base without hydraulic resistance.

Figure 5:
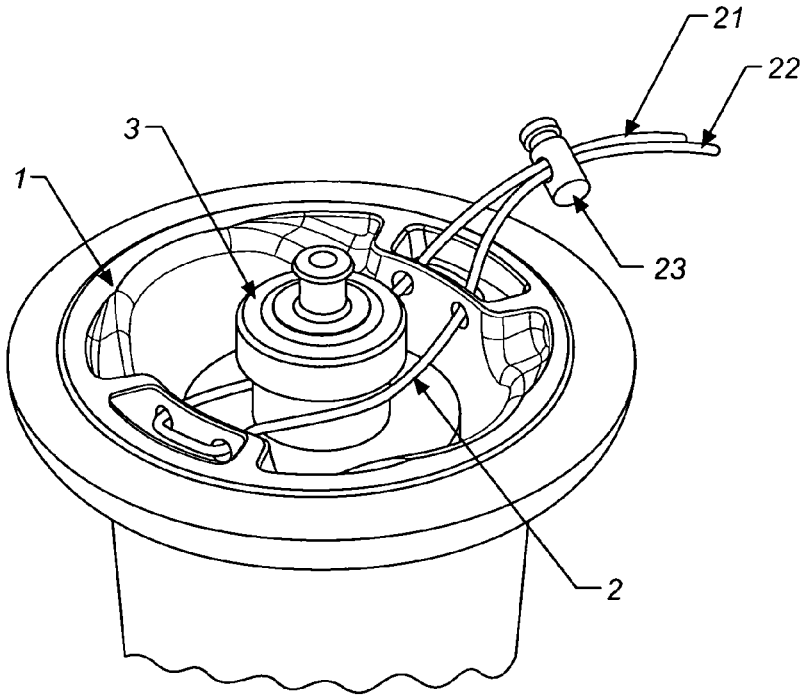
FIG. 5 is a view of a presently preferred embodiment of the stowage device in accordance with the present invention that allows for the adjustability of the shock cord.

FIG. 5 shows a presently preferred embodiment of the stowage device in accordance with the present invention incorporating a modified shock cord 2. In accordance with the preferred embodiment shown in FIG. 5, the shock cord 2 is tied more loosely, and is provided with a sliding clip 23 which slides along the shock cord to tighten or loosen the cord. Knots 21, 22 retain the clip 23 from sliding off. The clip 23 allows the user to adjust the tension in the shock cord 2, relaxing the shock cord when not necessary to retain a bottle or container or object 3. When tightened, the clip 23 preferably tucks into the shock cord cavity 14 in the main body 1.

The stowage device in accordance with the various embodiments of the present invention can be used on various watercraft, but is advantageously intended to be used on smaller, performance-oriented watercraft such as the Laser sailboat, kayaks, and catamarans, where space is tight and there are currently no immediately accessible places to stow a water bottle or other refreshment container or object or the like so that the bottle or container or object can be removed and replaced quickly and without using more than one hand. The stowage device in accordance with the various embodiments of the present invention is a device that can be retrofitted to any such boat by removing the inspection port cover, for example, the popular Viking Marine inspection port lid, and installing the stowage device in accordance with one of the various embodiments of the present invention in its place. As will be understood by persons skilled in the art, the Viking Marine inspection port lids currently simply cover a hole cut in the boat, which allows the owner to access the interior of the boat for cleaning and storage. The stowage device in accordance with the various embodiments of the present invention preferably uses the same thread pattern, so it merely screws into the existing ring and uses the same sealing surface. It can be removed to access the interior of the boat, so the existing inspection port lid is no longer necessary. Alternatively, a threaded adapter may be additionally employed and/or a bayonet or other attachment means may be employed to install the stowage device in the inspection port 4.

Figure 6:
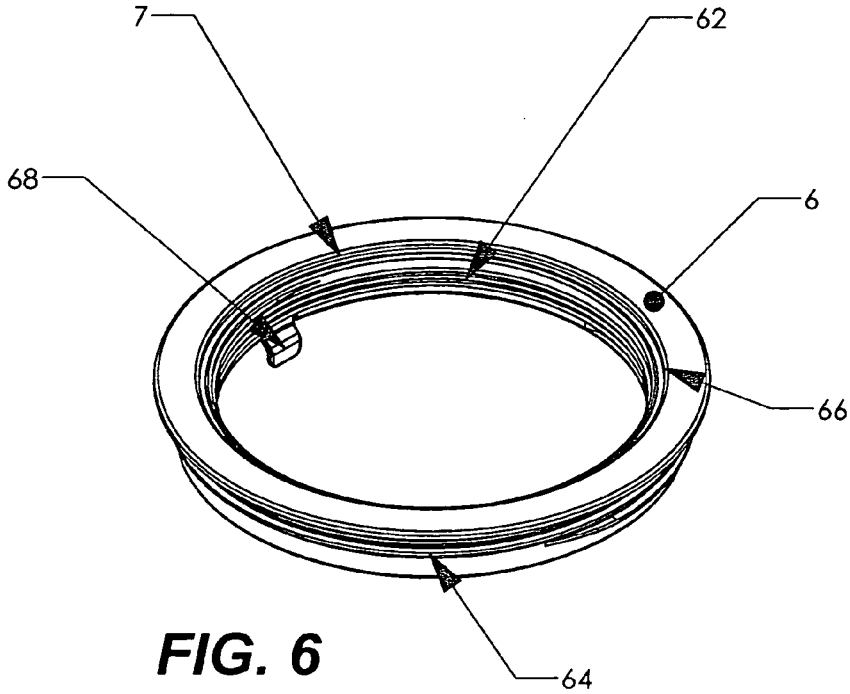
FIG. 6 is an isometric view of an adapter ring.

Considered in more detail, FIG. 6 illustrates an adapter ring 6, for example, to adapt a stowage device configured for a five-inch Viking Marine inspection port for installation in a six-inch Viking Marine inspection port. The adapter ring 6 comprises two sets of threads 62, 64, which may have different pitches. In the present example, the threads 62 correspond to the threads of a five-inch Viking Marine inspection port, and the threads 64 engage with the threads of a six-inch Viking Marine inspection port. As shown in FIG. 6, a sealing O-ring 7 is additionally disposed in a groove 66 of the adapter ring 6 to provide a watertight seal against the sealing lip 19 of the main body 1 of the stowage device.

Figure 7:
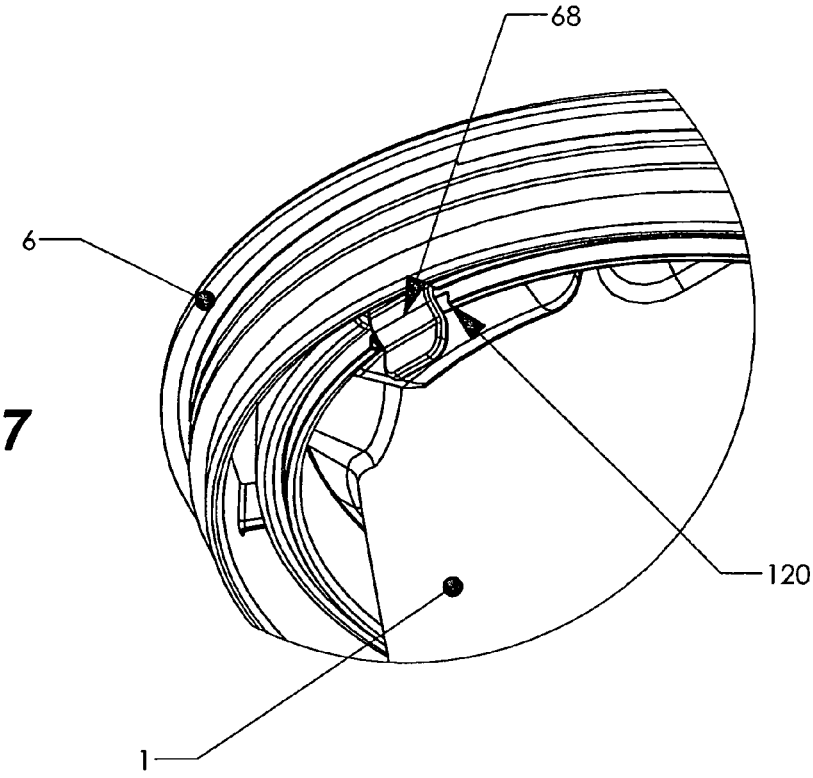
FIG. 7 is a detailed isometric view of the underside of the adapter ring shown in FIG. 6 with the storage device installed to form an assembly.
Figure 8:
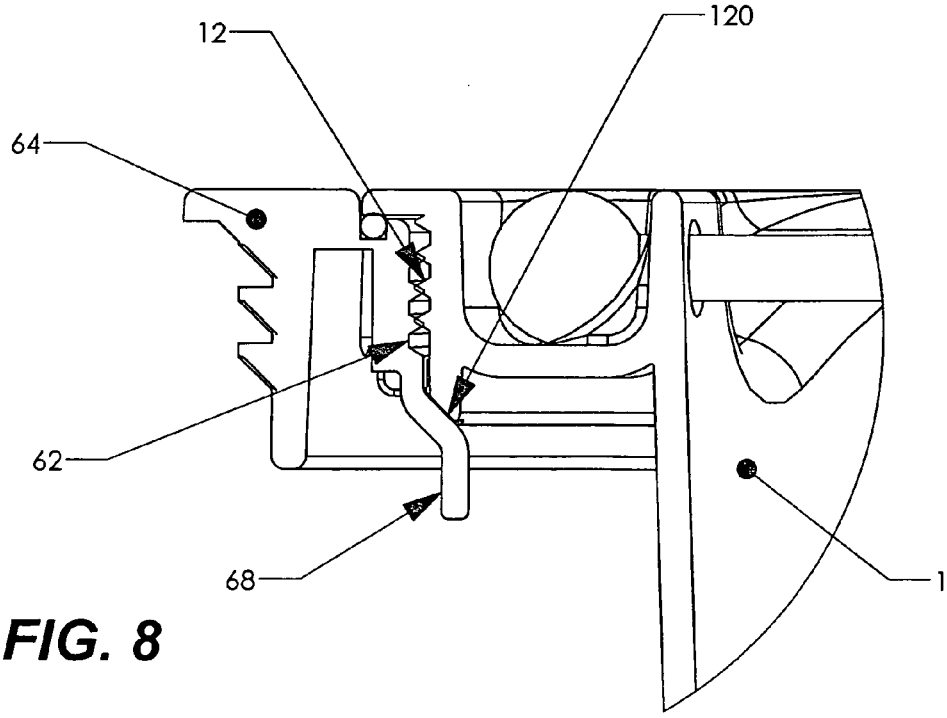
FIG. 8 is a detailed sectional view of the stowage device assembly shown in FIG. 7.

Preferably, as shown in FIG. 6, the adapter ring 6 additionally preferably comprises one or more locking tab(s) 68 disposed on the adapter ring to prevent the stowage device from unthreading from the adapter ring as the user unscrews the stowage device to remove it from a six-inch inspection port. Considered in more detail, FIG. 7 is a detailed isometric view of the underside of the adapter ring 6 with the storage device installed to form an assembly and shows how one or more notch(es) 120 are preferably provided in the threads 12 of main body 1 to accommodate the one or more locking tab(s) 68 protruding from the bottom of the adapter ring. Initially, when the user threads the stowage device onto the adapter ring 6, the base of the stowage device pushes the locking tab(s) 68 outwardly until the tab(s) is/are positioned opposite the notch(es) 120, whereupon the locking tab(s) 68 snap(s) into the notch(es). The locking tab(s) 68 is/are captured in the notch(es) 120, preventing unthreading unless the user pushes the tab(s) out of the notch(es) 120 in order to unthread the stowage device. FIG. 8 is a detailed sectional view of the stowage device assembled with the adapter ring 6 showing a locking tab 68 on the adapter ring captured in a corresponding notch 120 on the stowage device.

In accordance with one implementation of the stowage device in accordance with the various embodiments of the present invention, the stowage cavity 11 is sized to hold a majority of bike bottles and 12- to 16-ounce soda and sports drink bottles, so that no portion of the bottle extends above the top of the main body 1. This is so that stray cords, etc., cannot snag on the bottle during sailing. Larger or smaller bottles may be accommodated within such a stowage cavity 11 as well, but they may extend out or bounce around in the stowage cavity, respectively. Alternatively, a set of stowage devices of different depths can be provided. As a further alternative, in accordance with a modified embodiment of the stowage device in accordance with the present invention, the main body 1 may be constructed with a bellows portion intermediate the top and bottom of the main body and preferably in the region of the unflared portion of the main body, which can expand to provide a range of depths dependent on the height of the bottle or container or object 3.

In operation, the bottle or container or object 3 is inserted and removed from the stowage cavity 11 by pushing apart the shock cord 2 restraints. These restraints are configured in a U-shape so that the bottle or container or object 3 is held in place by the shock cord 2. When the bottle or container or object 3 is inserted and removed, the force of insertion or removal causes the shock cord 2 to spread apart, allowing the bottle or container or object to slide through the loop of the shock cord into or out of the stowage cavity 11. The purpose of the shock cord restraints is to hold the bottle or container or object 3 in place on rough seas or in the case that the boat 5 capsizes. Since in most situations the shock cord 2 is slightly flexed while holding the bottle or container or object 3, the bottle or container or object cannot move substantially when the boat is buffeted or capsizes and cannot therefore generate the force necessary to push the shock cord 2 apart and escape (as it does when the user applies an external force).

Alternatively, a shock cord 2 with the clip 23 may be employed so that the user can tighten and loosen the shock cord as necessary. In accordance with the alternative embodiment, the user inserts the bottle or container or object 3 while the shock cord is loose, and then pulls the ends of the shock cord through the clip 23 to tighten. When the bottle or container or object 3 is inserted and removed, the force of insertion or removal causes the shock cord 2 to spread apart, allowing the bottle or container or object to slide through the loop of the shock cord into or out of the stowage cavity 11. If the user later so desires, he or she may loosen the clip 23 and add slack to the shock cord 2 so that the bottle or container or object 3 is easy to remove. In rough conditions a tighter-drawn shock cord 2 provides a more secure hold, while in calm conditions, a looser-drawn shock cord provides greater ease of removal. Additionally, since the user can loosen the shock cord 2 as necessary, it is easier to use the stowage cavity 11 to store other objects, such as sunglasses, sunscreen, etc.

While the foregoing description has been with reference to particular embodiments and contemplated alternative embodiments of the present invention, it will be appreciated by those skilled in the art that changes in these embodiments may be made without departing from the principles and spirit of the invention. For example, the securing means may alternatively be a lock clip mounted to the lip 19 and spanning the main body 1; a rotatable finger mounted to the lip and pivotable to prevent dislodgment of an inserted bottle or container or object 3; a grab ring mounted or disposed within the stowage cavity 11 preferably in the region of the unflared portion of the main body; flexible barbs, ridges, or other grabbing extensions or a friction surface provided on the interior surface of the stowage cavity 11; a hinged cap attached to the lip 19; a Velcro strap; or other means known to persons skilled in the art for retaining an object in a stowage cavity. Accordingly, the scope of the present invention can only be ascertained with reference to the appended claims.

What is claimed is:

1. A stowage device selectively installed in an inspection port of a watercraft for securing an object aboard the watercraft, the stowage device comprising:

a main body comprising a stowage cavity, a sealing lip at an upper end of the main body, threads configured to match those of a cover for the inspection port and positioned proximate the sealing lip exterior to the stowage cavity, wherein the sealing lip extends outwardly from the stowage cavity beyond the threads; and securing means to releaseably retain the object in the stowage cavity;

whereby the stowage device is installed on the watercraft by removing an existing cover for the inspection port and threading the main body into the inspection port;

wherein the sealing lip of the main body includes a sealing surface that seals with a gasket of the inspection port of the watercraft to provide a secure, watertight seal therebetween.

2. The stowage device of claim 1 wherein the main body comprises a first cavity positioned at one side of the main body proximate the upper end of the main body, the first cavity having a first hole and a second hole, and a second cavity positioned at an opposite side of the main body proximate the upper end of the main body, the second cavity having a first hole and a second hole, and wherein the securing means is a shock cord which is tied at one end, threaded through the first hole in the first cavity, the first and second holes in the second cavity to form a U shape, and through the second hole in the first cavity and terminated at another end by a knot, whereby the shock cord may stretch apart and expand laterally so that the object can be manually pushed in and pulled out of the stowage cavity in the main body but, if the watercraft were to capsize, the movement of the object is constrained, and cannot produce enough force or momentum to stretch the shock cord apart so as to release the object.

3. The stowage device of claim 2 wherein the first cavity has a depth sufficient to contain the knots disposed in the first cavity such that the knots are substantially flush with the upper end of the main body.

4. The stowage device of claim 2 wherein the shock cord is a commercially available one-eighth-inch diameter shock cord commonly available for sale at outdoor equipment or hardware stores.

5. The stowage device of claim 1 wherein the inspection port is one of a five- or six-inch inspection port cover previously installed on the watercraft.

6. The stowage device of claim 1, further comprising indentations at the upper end of the main body to facilitate threading the main body on and off to install or remove the stowage device, respectively.

7. The stowage device of claim 1 wherein the sealing lip seals with the gasket, the gasket comprising an existing O-ring of the inspection port to provide a secure, watertight seal.

8. The stowage device of claim 1 wherein a portion of the stowage cavity of the main body flares out between the upper and a lower end of the stowage cavity, whereby a larger elliptical opening is created at the upper end of the main body to allow a user more space to fit his or her hand in order to retrieve a shorter object, while still tightly constraining the bottom of the object.

9. The stowage device of claim 8 wherein an upper end of the flared portion of the stowage cavity of the main body is sufficiently inward of the threads so that the stowage device is fully compatible with the additional installation of a conventional inspection port bag to enable stowage keys, a cell phone, wallet, inside the port bag even with the stowage device installed.

10. The stowage device of claim 1 wherein the lower end of the stowage cavity of the main body has a depth relative to the upper end of the main body of approximately nine inches to ensure that the top of the vast majority of commonly used objects is approximately flush with the upper end of the main body, whereby the top of the object will not catch on any stray ropes sweeping across the deck of a watercraft.

11. The stowage device of claim 1, further comprising a drain port channel incorporated on at least one side of the stowage cavity, whereby the object is pressed down into the stowage cavity, any water at the lower end of the main body is forced out through the top of the drain port channel, so that the object is inserted completely.

12. The stowage device of claim 1 wherein the main body further comprises a first cavity positioned at one side of the main body proximate the upper end of the main body, the first cavity having a first hole and a second hole, and a second cavity positioned at an opposite side of the main body proximate the upper end of the main body, the second cavity having a first hole and a second hole, and wherein the securing means is a shock cord which is tied at one end, threaded through the first hole in the first cavity, the first and second holes in the second cavity to form a U shape, and through the second hole in the first cavity and terminated at another end by a knot, and further comprising a sliding clip which is slidable along the shock cord to adjust the tension in the shock cord, whereby the shock cord can be tightened to retain the object and the shock cord can be relaxed when not necessary to retain the object, whereby when tightened the shock cord retains the object in the stowage cavity in the main body and, if the watercraft were to capsize, the movement of the object is constrained, and cannot produce enough force or momentum to stretch the shock cord apart so as to release the object.

13. The stowage device of claim 12 wherein the sliding clip is tucked into the first cavity in the main body after the shock cord is tightened.

14. A stowage device selectively installed on a mobile conveyance for securing an object aboard the conveyance, the stowage device comprising:

a main body comprising a stowage cavity, a sealing lip at an upper end of the main body, threads configured to screw into an aperture provided in the conveyance and positioned proximate the sealing lip exterior to the stowage cavity, wherein the sealing lip extends outwardly from the stowage cavity beyond the threads; and securing means to releaseably retain a bottle or container or object in the stowage cavity;

whereby the stowage device is installed on the conveyance by threading in the main body into the aperture;

wherein the upper end of the main body includes finger stops that facilitate threading the main body into the inspection port.

15. The stowage device of claim 14 wherein the main body comprises a first cavity positioned at one side of the main body proximate the upper end of the main body, the first cavity having a first hole and a second hole, and a second cavity positioned at an opposite side of the main body proximate the upper end of the main body, the second cavity having a first hole and a second hole, and wherein the securing means is a shock cord which is tied at one end, threaded through the first hole in the first cavity, the first and second holes in the second cavity to form a U shape, and through the second hole in the first cavity and terminated at another end by a knot, whereby the shock cord may stretch apart and expand laterally so that the object can be manually pushed in and pulled out of the stowage cavity in the main body but, if the watercraft were to capsize, the movement of the object is constrained, and cannot produce enough force or momentum to stretch the shock cord apart so as to release the object.

16. The stowage device of claim 15 wherein the first cavity has a depth sufficient to contain a knots disposed in the first cavity such that the knots are substantially flush with the upper end of the main body.

17. The stowage device of claim 15 wherein the shock cord is a commercially available one-eighth-inch diameter shock cord commonly available for sale at outdoor equipment or hardware stores.

18. The stowage device of claim 14, further comprising indentations at the upper end of the main body to facilitate threading the main body on and off to install or remove the stowage device, respectively.

19. The stowage device of claim 14 wherein the sealing lip seals with an existing O-ring of the inspection port to provide a secure, watertight seal.

20. The stowage device of claim 14 wherein a portion of the stowage cavity of the main body flares out between the upper and a lower end of the stowage cavity, whereby a larger elliptical opening is created at the upper end of the main body to allow a user more space to fit his or her hand in order to retrieve a shorter object, while still tightly constraining the bottom of the object.

21. The stowage device of claim 14 wherein the lower end of the stowage cavity of the main body has a depth relative to the upper end of the main body of approximately nine inches to ensure that the top of the vast majority of commonly used objects is approximately flush with the upper end of the main body.

22. The stowage device of claim 14, further comprising a drain port channel incorporated on at least one side of the stowage cavity, whereby when the object is pressed down into the stowage cavity, any water at the lower end of the main body is forced out through the top of the drain port channel, so that the object will be inserted completely.

23. The stowage device of claim 14 wherein the main body further comprises a first cavity positioned at one side of the main body proximate the upper end of the main body, the first cavity having a first hole and a second hole, and a second cavity positioned at an opposite side of the main body proximate the upper end of the main body, the second cavity having a first hole and a second hole, and wherein the securing means is a shock cord which is tied at one end, threaded through the first hole in the first cavity, the first and second holes in the second cavity to form a U shape, and through the second hole in the first cavity and terminated at another end by a knot, and further comprising a sliding clip which is slidable along the shock cord to adjust the tension in the shock cord, whereby the shock cord can be tightened to retain the object and the shock cord can be relaxed when not necessary to retain the object, whereby when tightened the shock cord retains the object in the stowage cavity in the main body and, if the watercraft were to capsize, the movement of the object is constrained, and cannot produce enough force or momentum to stretch the shock cord apart so as to release the object.

24. The stowage device of claim 23 wherein the sliding clip is tucked into the first cavity in the main body after the shock cord is tightened.

25. A stowage device selectively installed in an inspection port of a watercraft for securing an object aboard the watercraft, the stowage device comprising:

a main body comprising a stowage cavity, a sealing lip at an upper end of the main body, threads configured to match those of a cover for the inspection port and positioned proximate the sealing lip exterior to the stowage cavity, wherein the sealing lip extends outwardly from the stowage cavity beyond the threads; and resilient elastic material that extends over the upper end of the main body from opposing sides of the sealing lip to releaseably retain the object in the stowage cavity such that the resilient elastic securing material can stretch apart and expand laterally so that the object can be manually pushed in and pulled out of the stowage cavity in the main body yet is secured therein once pushed in;

whereby the stowage device is installed on the watercraft by removing an existing cover for the inspection port and threading the main body into the inspection port.

26. The stowage device of claim 25 wherein the main body comprises a first cavity positioned at one side of the main body proximate the upper end of the main body, the first cavity having a first hole and a second hole, and a second cavity positioned at an opposite side of the main body proximate the upper end of the main body, the second cavity having a first hole and a second hole, and wherein the securing means is a shock cord which is tied at one end, threaded through the first hole in the first cavity, the first and second holes in the second cavity to form a U shape, and through the second hole in the first cavity and terminated at another end by a knot, whereby the shock cord may stretch apart and expand laterally so that the object can be manually pushed in and pulled out of the stowage cavity in the main body but, if the watercraft were to capsize, the movement of the object is constrained, and cannot produce enough force or momentum to stretch the shock cord apart so as to release the object.

27. The stowage device of claim 26 wherein the first cavity has a depth sufficient to contain a knots disposed in the first cavity such that the knots are substantially flush with the upper end of the main body.

28. The stowage device of claim 26 wherein the shock cord is a commercially available one-eighth-inch diameter shock cord commonly available for sale at outdoor equipment or hardware stores.

29. The stowage device of claim 25 wherein the inspection port is one of a five- or six-inch inspection port cover previously installed on the watercraft.

30. The stowage device of claim 25, further comprising indentations at the upper end of the main body to facilitate threading the main body on and off to install or remove the stowage device, respectively.

31. The stowage device of claim 25 wherein the sealing lip seals with an existing O-ring of the inspection port to provide a secure, watertight seal.

32. The stowage device of claim 25 wherein a portion of the stowage cavity of the main body flares out between the upper and a lower end of the stowage cavity, whereby a larger elliptical opening is created at the upper end of the main body to allow a user more space to fit his or her hand in order to retrieve a shorter bottle or container or object, while still tightly constraining the bottom of the object.

33. The stowage device of claim 32 wherein an upper end of the flared portion of the stowage cavity of the main body is sufficiently inward of the threads so that the stowage device is fully compatible with the additional installation of a conventional inspection port bag to enable stowage keys, a cell phone, wallet, inside the port bag even with the stowage device installed.

34. The stowage device of claim 25 wherein the lower end of the stowage cavity of the main body has a depth relative to the upper end of the main body of approximately nine inches to ensure that the top of the vast majority of commonly used objects is approximately flush with the upper end of the main body, whereby the top of the object will not catch on any stray ropes sweeping across the deck of the watercraft.

35. The stowage device of claim 25, further comprising a drain port channel incorporated on at least one side of the stowage cavity, whereby when the object is pressed down into the stowage cavity, any water at the lower end of the main body is forced out through the top of the drain port channel, so that the object will be inserted completely.

36. The stowage device of claim 25 wherein the main body further comprises a first cavity positioned at one side of the main body proximate the upper end of the main body, the first cavity having a first hole and a second hole, and a second cavity positioned at an opposite side of the main body proximate the upper end of the main body, the second cavity having a first hole and a second hole, and wherein the securing means is a shock cord which is tied at one end, threaded through the first hole in the first cavity, the first and second holes in the second cavity to form a U shape, and through the second hole in the first cavity and terminated at another end by a knot, and further comprising a sliding clip which is slidable along the shock cord to adjust the tension in the shock cord, whereby the shock cord can be tightened to retain the object and the shock cord can be relaxed when not necessary to retain the object, whereby when tightened the shock cord retains the object in the stowage cavity in the main body and, if the watercraft were to capsize, the movement of the object is constrained, and cannot produce enough force or momentum to stretch the shock cord apart so as to release the object.

37. The stowage device of claim 36 wherein the sliding clip is tucked into the first cavity in the main body after the shock cord is tightened.

38. A stowage device selectively installed on a mobile conveyance for securing an object aboard the conveyance, the stowage device comprising:

a main body comprising a stowage cavity, a sealing lip at an upper end of the main body, threads configured to screw into an aperture provided in the conveyance and positioned proximate the sealing lip exterior to the stowage cavity, wherein the sealing lip extends outwardly from the stowage cavity beyond the threads; and resilient elastic material to releaseably retain the object in the stowage cavity;

whereby the stowage device is installed on the conveyance by threading the main body into the aperture;

wherein the main body comprises a first cavity positioned at one side of the main body proximate the upper end of the main body, and a second cavity positioned at an opposite side of the main body proximate the upper end of the main body, and wherein the resilient elastic material is secured between the first cavity and the second cavity and can be stretched apart and expanded laterally so that the object can be manually pushed in and pulled out of the stowage cavity.

39. The stowage device of claim 38 wherein the first cavity has a first hole and a second hole, the second cavity has a first hole and a second hole, and wherein the securing means is a shock cord which is tied at one end, threaded through the first hole in the first cavity, the first and second holes in the second cavity to form a U shape, and through the second hole in the first cavity and terminated at another end by a knot, whereby the shock cord may stretch apart and expand laterally so that the object can be manually pushed in and pulled out of the stowage cavity in the main body but, if the watercraft were to capsize, the movement of the object is constrained, and cannot produce enough force or momentum to stretch the shock cord apart so as to release the object.

40. The stowage device of claim 39 wherein the first cavity has a depth sufficient to contain a knots disposed in the first cavity such that the knots are substantially flush with the upper end of the main body.

41. The stowage device of claim 39 wherein the shock cord is a commercially available one-eighth-inch diameter shock cord commonly available for sale at outdoor equipment or hardware stores.

42. The stowage device of claim 38, further comprising indentations at the upper end of the main body to facilitate threading the main body on and off to install or remove the stowage device, respectively.

43. The stowage device of claim 38 wherein the sealing lip seals with an existing O-ring of the inspection port to provide a secure, watertight seal.

44. The stowage device of claim 38 wherein a portion of the stowage cavity of the main body flares out between the upper and a lower end of the stowage cavity, whereby a larger elliptical opening is created at the upper end of the main body to allow a user more space to fit his or her hand in order to retrieve a shorter object, while still tightly constraining the bottom of the object.

45. The stowage device of claim 38 wherein the lower end of the stowage cavity of the main body has a depth relative to the upper end of the main body of approximately nine inches to ensure that the top of the vast majority of commonly used objects is approximately flush with the upper end of the main body.

46. The stowage device of claim 38, further comprising a drain port channel incorporated on at least one side of the stowage cavity, whereby when the object is pressed down into the stowage cavity, any water at the lower end of the main body is forced out through the top of the drain port channel, so that the object will be inserted completely.

47. The stowage device of claim 38 wherein the main body further comprises a first cavity positioned at one side of the main body proximate the upper end of the main body, the first cavity having a first hole and a second hole, and a second cavity positioned at an opposite side of the main body proximate the upper end of the main body, the second cavity having a first hole and a second hole, and wherein the securing means is a shock cord which is tied at one end, threaded through the first hole in the first cavity, the first and second holes in the second cavity to form a U shape, and through the second hole in the first cavity and terminated at another end by a knot, and further comprising a sliding clip which is slidable along the shock cord to adjust the tension in the shock cord, whereby the shock cord can be tightened to retain the object and the shock cord can be relaxed when not necessary to retain the object, whereby when tightened the shock cord retains the object in the stowage cavity in the main body and, if the watercraft were to capsize, the movement of the object is constrained, and cannot produce enough force or momentum to stretch the shock cord apart so as to release the object.

48. The stowage device of claim 47 wherein the sliding clip is tucked into the first cavity in the main body after the shock cord is tightened.

49. A method for stowing an object aboard a watercraft having an inspection port, the method comprising the steps of:

providing a stowage device selectively installed in the inspection port of the watercraft for securing a bottle or container or object, the stowage device comprising a main body having a stowage cavity, a sealing lip at an upper end of the main body, threads configured to match those of a cover for the inspection port and positioned proximate the sealing lip exterior to the stowage cavity, wherein the sealing lip extends outwardly from the stowage cavity beyond the threads, and securing means to releaseably retain the bottle or container or object in the stowage cavity;

installing the stowage device on the watercraft by removing the existing cover for the inspection port and threading the main body into the inspection port, thereby sealing the main body of the stowage cavity into the inspection port via the sealing lip that seals with a gasket of the inspection port; and selectively inserting the bottle or container or object into the stowage cavity such that the bottle or container or object is held in place by the securing means;

thereby retaining the bottle or container or object in place on rough seas or in the case that the watercraft capsizes.

50. A method for stowing a water bottle or other liquid refreshment container or other object aboard a mobile conveyance, the method comprising the steps of:

providing an aperture in the conveyance;

providing a stowage device selectively installed in the aperture for securing the bottle or container or object, the stowage device comprising a main body having a stowage cavity, a sealing lip at an upper end of the main body, threads configured to thread into the aperture and positioned proximate the sealing lip exterior to the stowage cavity, wherein the sealing lip extends outwardly from the stowage cavity beyond the threads, and securing means to releaseably retain the bottle or container or object in the stowage cavity;

installing the stowage device on the mobile conveyance by threading the main body into the aperture by employing finger stops provided on the main body that facilitate threading the main body into the aperture; and selectively inserting the bottle or container or object into the stowage cavity such that the bottle or container or object is held in place by the securing means;

thereby retaining the bottle or container or object in place.

51. A method for stowing a water bottle or other liquid refreshment container or other object aboard a watercraft having an inspection port, the method comprising the steps of:

providing a stowage device selectively installed in the inspection port of the watercraft for securing the bottle or container or object, the stowage device comprising a main body having a stowage cavity, a sealing lip at an upper end of the main body, threads configured to match those of a cover for the inspection port and positioned proximate the sealing lip exterior to the stowage cavity, wherein the sealing lip extends outwardly from the stowage cavity beyond the threads, and resilient elastic material to releaseably retain the bottle or container or object in the stowage cavity, wherein the resilient elastic material is secured between opposing sides of the upper end of the main body to retain the bottle therein;

installing the stowage device on the watercraft by removing the existing cover for the inspection port and threading the main body into the inspection port; and selectively inserting the bottle or container or object into the stowage cavity such that the bottle or container or object is held in place by the resilient elastic material;

thereby retaining the bottle or container or object in place on rough seas or in the case that the watercraft capsizes.

52. A method for stowing a water bottle or other liquid refreshment container or other object aboard a mobile conveyance, the method comprising the steps of:

providing an aperture in the conveyance;

providing a stowage device selectively installed in the aperture for securing the bottle or container or object, the stowage device comprising a main body having a stowage cavity, a sealing lip at an upper end of the main body, threads configured to thread into the aperture and positioned proximate the sealing lip exterior to the stowage cavity, wherein the sealing lip extends outwardly from the stowage cavity beyond the threads, and resilient elastic material to releaseably retain the bottle or container or object in the stowage cavity;

installing the stowage device on the watercraft by threading the main body into the aperture using cavities disposed on opposing sides of the upper end of the main body to facilitate threading the main body into the aperture; and selectively inserting the bottle or container or object into the stowage cavity such that the bottle or container or object is held in place by the resilient elastic material;

thereby retaining the bottle or container or object in place.

* * * * *